US006539985B2

(12) United States Patent
Shinada et al.

(10) Patent No.: US 6,539,985 B2
(45) **Date of Patent: *Apr. 1, 2003**

(54) METHOD OF FILLING AN INK CARTRIDGE WITH INK AND AN APPARATUS THEREOF

(75) Inventors: Satoshi Shinada; Yuichi Nakamura; Hisashi Koike; Yukiharu Suda, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/904,863

(22) Filed: Jul. 16, 2001

(65) Prior Publication Data

US 2001/0052370 A1 Dec. 20, 2001

Related U.S. Application Data

(62) Division of application No. 09/725,022, filed on Nov. 29, 2000, which is a continuation of application No. PCT/JP00/01846, filed on Mar. 27, 2000.

(30) Foreign Application Priority Data

Mar. 29, 1999 (JP) ..... 11-86360

(51) Int. Cl.[7] ..... B65B 1/04

(52) U.S. Cl. ..... 141/2; 141/18; 141/114; 141/346; 347/86

(58) Field of Search ..... 141/346–351, 141/114, 2, 18; 347/84–87, 7

(56) References Cited

U.S. PATENT DOCUMENTS

| | | | | |
|---|---|---|---|---|
| 5,479,968 A | | 1/1996 | Sanchez et al. | |
| 5,732,751 A | | 3/1998 | Schmidt et al. | 347/86 |
| 5,828,395 A | | 10/1998 | Takata | 347/86 |
| 6,036,305 A | | 3/2000 | Nagasaki et al. | 347/86 |
| 6,045,207 A | * | 4/2000 | Mochizuki et al. | |
| 6,058,984 A | * | 5/2000 | Sato | |
| 6,158,851 A | * | 12/2000 | Zepeda | |
| 6,332,481 B1 | | 12/2001 | Shinada et al. | |

FOREIGN PATENT DOCUMENTS

| | | | |
|---|---|---|---|
| EP | 0 699 532 A2 | 3/1996 | B41J/2/175 |
| EP | 196 37 879 A | 6/1997 | |
| EP | 0 906 830 A2 | 4/1999 | B41J/2/175 |
| JP | 7-276659 | 10/1995 | B41J/2/175 |
| JP | 9-39262 | 2/1997 | B41J/2/175 |
| JP | 10-193635 | 7/1998 | |
| JP | 10-193636 | 7/1998 | B41J/2/175 |
| JP | 11-48490 A | 2/1999 | |
| JP | 11-58774 | 3/1999 | B41J/2/175 |
| JP | 11-207990 | 8/1999 | B41J/2/175 |

* cited by examiner

*Primary Examiner*—Steven C. Douglas
(74) *Attorney, Agent, or Firm*—Sughrue Mion, PLLC

(57) ABSTRACT

Ink is filled in an ink cartridge having a housing communicating with ambient air through an air communicating hole, a porous member impregnating with ink, an ink supply port, and a valve device including a valve body always urged by a spring and a valve seat abutting against the valve body, and ink is filled in the housing of the ink cartridge through the ink supply port.

7 Claims, 10 Drawing Sheets

METHOD OF FILLING AN INK CARTRIDGE WITH INK AND AN APPARATUS THEREOF

This is a divisional of application Ser. No. 09/725,022 (Confirmation No. 8957) filed Nov. 29, 2000, the disclosure of which is incorporated herein by reference.

This is a continuation application of PCT/JP00/01846 filed on Mar. 27, 2000, the contents of which are incorporated herein by reference. This patent application also claims priority based on Japanese Patent Application H11-86360 filed on Mar. 29, 1999, the contents of which are incorporated herein by reference.

BACKGROUND OF THE INVENTION

1. Technical Field of the Invention

The present invention relates generally to a method of and apparatus of filling an ink cartridge, which supplies ink to a print head of an ink jet type recording apparatus for ejecting ink droplets in accordance with a print signal, with ink, which ink cartridge is detachably mounted on a carriage of the recording apparatus.

2. Related Art

A print head of an ink jet type recording apparatus connects to an ink cartridge through an ink supply passage, so that ink is supplied from the ink cartridge to the print head. Generally, with the ink cartridge mounted on the carriage of the recording apparatus, a porous member impregnating with ink is accommodated within a housing of the ink cartridge having an air communication hole for the sake of preventing ink level from varying due to the reciprocating movement of the carriage, and the ink is supplied therefrom to the print head through an ink supply port formed on the housing.

When ink is filled in the ink cartridge thus designed, it is required that ink is filled sufficiently at least in the vicinity of the ink supply port. Otherwise, air which enters the housing through the air communication hole during the printing operation of the recording apparatus may reach the ink supply port, which may cause a problem that the air at the ink supply port would block the smooth flow of ink and certain amount of ink is remained within the housing. In addition, air may enter the print head and cover nozzles which may cause the undesirable white dot phenomena in which no ink droplet is ejected through the nozzle as the ink flow is blocked by the air. Those problems would deteriorate the print quality.

On the other hand, the ink cartridge with ink completely depleted has been conventionally replaced with anew ink cartridge and the old ink cartridge has been disposed. However, it is preferable to reuse the depleted ink cartridge for the purpose of preserving resources. Unexamined Japanese Patent Application No. 9-39262, for example, discloses an ink refilling technique in which ink is press-filling through an air communication hole formed in an ink cartridge. However, the air communication hole is generally designed to have a large fluid resistance in an effort to suppress evaporation of ink housed within the ink cartridge. For example, the air communication hole constructed to open to ambient air via a capillary action. Therefore, it is required to take relatively long time to fill or refill ink in the ink cartridge through the air communication hole. In addition, after the ink filling or refilling operation ink which is remained in the air communication hole may be dried out and solidified to close the hole, thereby to stop the air intake through the air communication hole and to block ink supply through the ink supply port to the print head. This is another problem.

Furthermore, according to the conventional ink refilling technique as disclosed in JPA No. 9-39262, since ink is filled through the air communication hole which positions opposite to the ink supply port, ink filling condition in the vicinity of the ink supply port, which influences the ink supply performance of the ink cartridge, may not be high enough, and the ink supply to the print head would become unstable. Moreover, because the pores of the porous member housed in the depleted ink cartridge hold air instead of ink as ink has been exhausted through the ink supply port, it is difficult to fill ink entirely within the ink cartridge.

SUMMARY OF THE INVENTION

The present invention was made in view of the foregoing problems and difficulties accompanying the conventional ink cartridge for an ink jet type recording apparatus. Accordingly, it is an object of the present invention to provide a method of filling ink in an ink cartridge capable of sufficiently filling ink at a short time with a high filling condition particularly in the vicinity of the ink supply port. Another object of the present invention is to provide an apparatus of filing ink in the ink cartridge suitable for performing the method of the present invention.

According to the present invention, ink is filled in an ink cartridge having a housing communicating with ambient air through an air communicating hole, a porous member impregnating with ink, an ink supply port, and a valve device including a valve body always urged by a spring and a valve seat abutting against the valve body, and ink is filled in the housing of the ink cartridge through the ink supply port.

When the ink supply port of the ink cartridge is mounted on an ink injection tube, the valve body is pushed up by the ink injection tube to release the ink supply passage. Thereafter the ink is injected by the ink injection tube through the ink supply port, so that ink is impregnated in the porous member which is previously decompressed.

Accordingly, according to the present invention, it is realized that ink can be sufficiently filled at a short time with a high filling condition particularly in the vicinity of the ink supply port.

DESCRIPTION OF THE PREFERRED EMBODIMENTS

Preferred embodiments of the present invention will be described in detail with reference to accompanying drawings.

Figure 1:
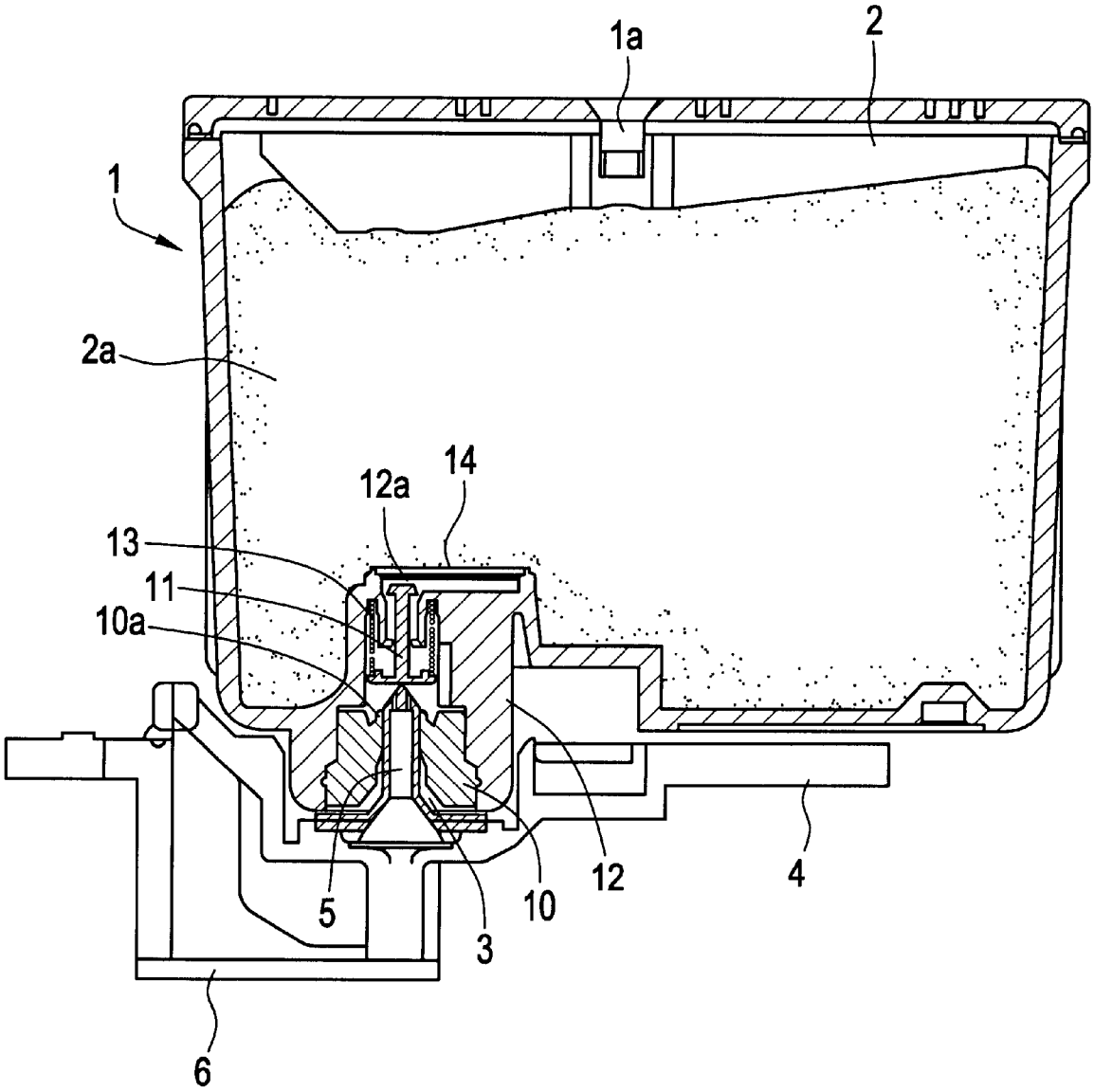
FIG. 1 is a cross-sectional view showing an ink cartridge mounted on a carriage of a recording apparatus to which the present invention is applicable.

FIG. 1 is a cross-sectional view showing an ink cartridge mounted on a carriage of a recording apparatus to which the present invention is applicable. As shown in FIG. 1, an ink cartridge 1 is provided with an ink chamber 2, a porous member 2*a* impregnating with ink and housed in the ink chamber 2, an ink supply port 3 formed on one wall and communicating with the ink chamber 2, and an air communicating hole 1*a* formed on an upper wall. When the ink cartridge is mounted on a predetermined position of a carriage 4 to which a print head 6 is secured, an ink supply needle 5 communicating with the print head 6 comes into engagement liquid-sealably with the ink supply port 3, so that ink in the ink chamber 2, that is, ink impregnated in the porous member 2*a* according to the present embodiment, is supplied to the print head 6.

A packing 10 fitted in the ink supply port 3 is provided with a cylindrical through hole formed in the center thereof which is liquid-sealably engageable with the ink supply needle 5. The packing 10 is formed at the ink chamber 2 side thereof a valve seat 10*a* which is closed by a valve body 11 described later. The valve seat 10*a* is expanded to open by inserting the ink supply needle 5.

A cylindrical ink introducing member 12 having an opening 12*a* communicating with the ink chamber 2 is fitted over the packing 10. The valve body 1 is disposed within the ink introducing member 12 and always urged against the valve seat 10*a* by a spring 13, so that the valve body 11 is slidable in an axial direction of the ink introducing member 12. A filter 14 is secured at an upper edge of the ink supply port 3 in such a manner that the filter 14 contacts the porous member 2*a* housed in the ink cartridge 1.

Figure 2:
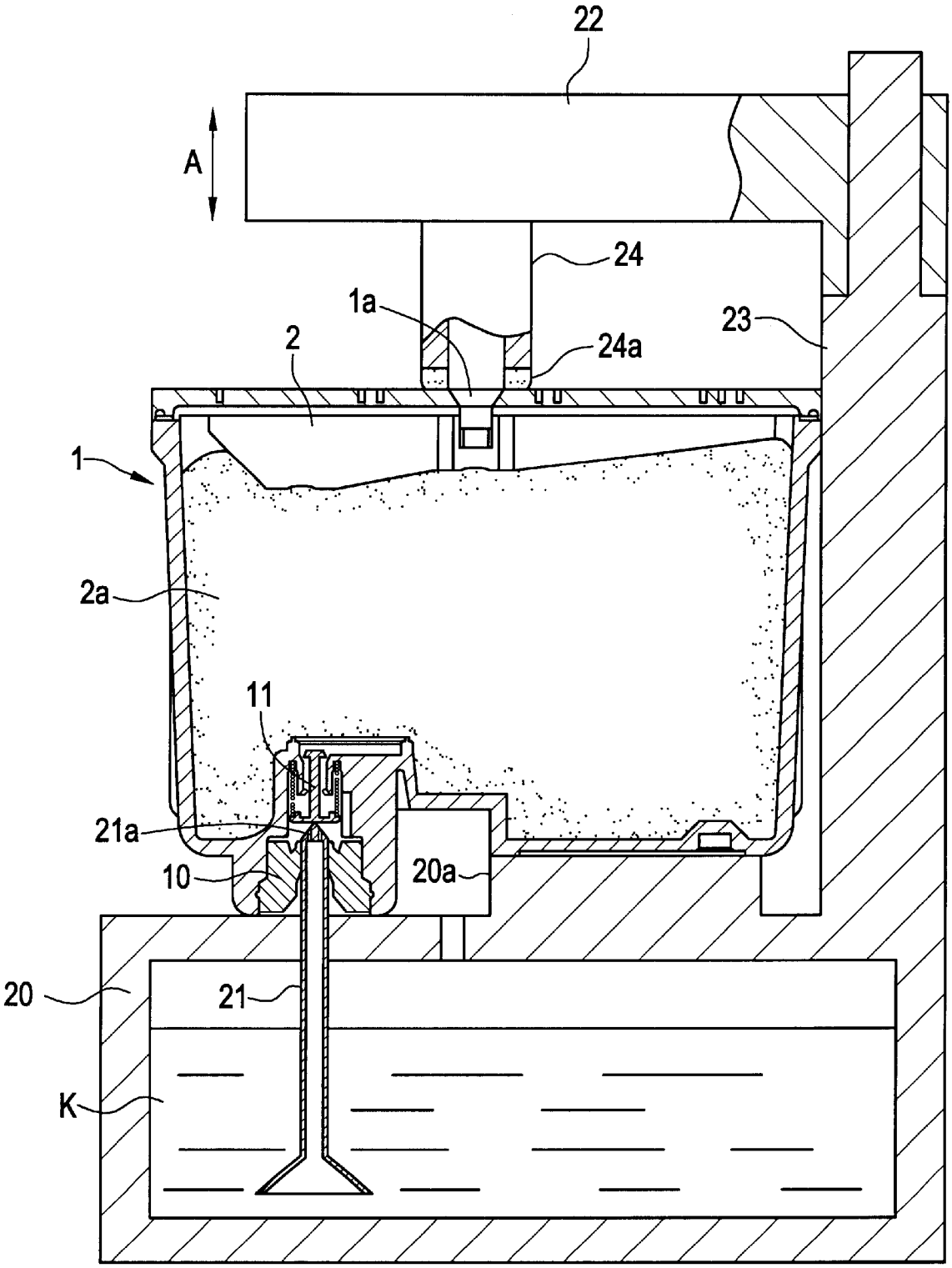
FIG. 2 shows an ink filling apparatus according to a first embodiment of the present invention.

FIG. 2 shows an ink filling apparatus according to a first embodiment of the present invention. An ink reservoir tank 20 is provided at an upper part thereof with a base 20*a* on which the ink cartridge 1 is mounted at a predetermined position. An ink filling pipe 21 penetrates the ink reservoir tank 20. The ink filling pipe 21 has an upper part which is liquid-sealably engageable with the ink supply port 3 of the ink cartridge 1 and a lower part which communicates with ink K contained in the ink reservoir tank 20. As shown in FIG. 2, a tip end of the ink filling pipe 21 is tapered like the ink supply needle 5 communicating with the print head of the recording apparatus. An ink flow outlet 21*a* is formed in the tip end of the ink filling pipe 21 through which ink K is filled from the ink reservoir tank 20 to the ink cartridge 1. The projecting length of the ink filling pipe 21 is so adjusted that the tip end of the ink filling pipe 21 make the valve body 11 sufficiently separate from the valve seat 10*a* when the ink cartridge 1 is mounted on the base 20*a* for filling ink K.

The ink filling apparatus according to the invention is also provided with a vacuum section 22 over the ink cartridge 1 for generating negative pressure in the ink cartridge 1 through the air communicating hole 1*a* formed in an upper wall of the ink cartridge 1. The vacuum section 22 is supported by a stand 23 extending upward from a position which does not obstruct the mounting of the ink cartridge 1, in such a manner that the vacuum section 22 is slidable in a vertical direction, i.e., along an arrow A shown in FIG. 2. The vacuum section 22 includes at an end thereof a vacuum pipe 24 having a connecting port 24*a* which is resiliently abuts against the air communicating hole 1*a* of the ink cartridge 1 while keeping airtight and the other end of the vacuum section 22 connects to a vacuum pump not shown.

Figure 3B:
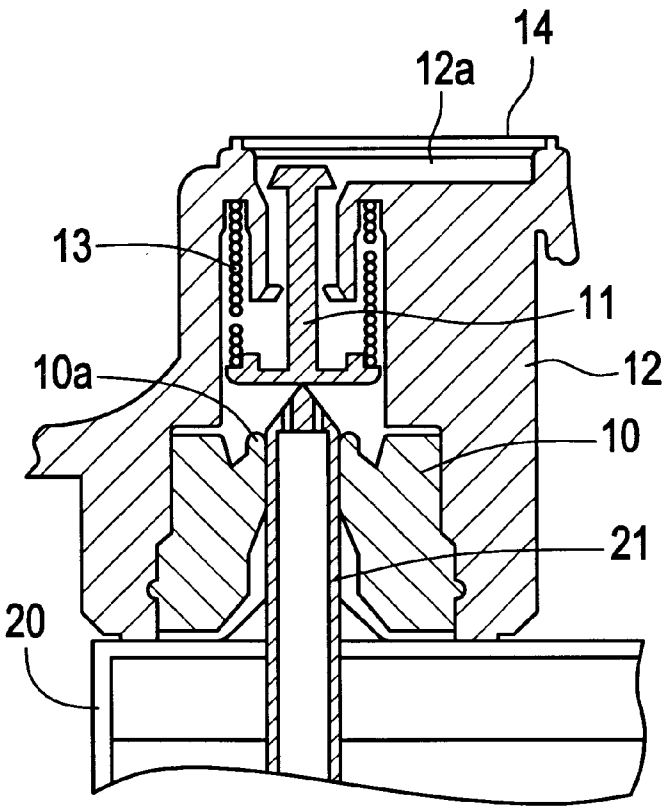
FIGS. 3A and 3B are views showing the process of mounting the ink cartridge onto the ink filling apparatus.
Figure 3A:
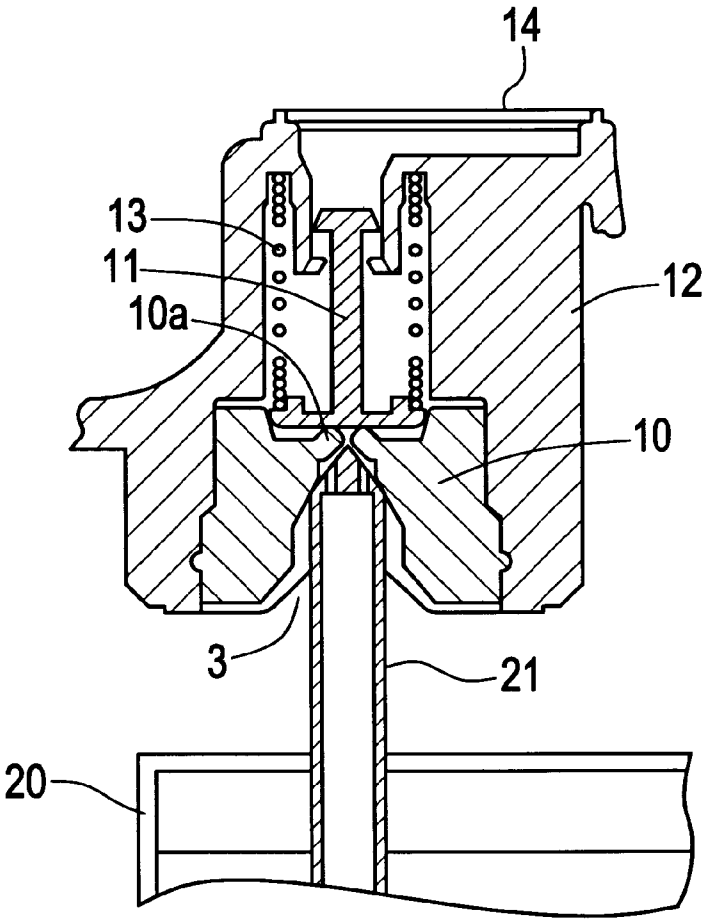

The operation of the ink filling apparatus according to the present embodiment shown in FIGS. 1 and 2 will be described hereinbelow with reference to FIGS. 3A and 3B. FIGS. 3A and 3B are views showing the process of mounting the ink cartridge onto the ink filling apparatus.

When the ink cartridge 1 is mounted on the carriage 4 of the recording apparatus, the valve body 11 is pushed up by the tip end of the ink supply needle 5 as shown in FIG. 1 to thereby release the ink supply passage and allow ink in the ink chamber 2 to flow out of the ink cartridge 1 to the print head 6 at an amount required for ejecting ink droplets from the nozzles.

When the ink in the ink cartridge 1 is depleted, the ink cartridge 1 is detached from the carriage 4 and mounted on the ink filling apparatus shown in FIG. 2. While the depleted ink cartridge 1 is mounted on the base 20*a* of the ink filling apparatus, the ink supply port 3 is first accurately positioned with respect to the ink filling pipe 21 as shown in FIG. 3A and, thereafter, the ink cartridge 1 is mounted on the base 20*a* of the ink reservoir tank 20 as shown in FIG. 3B so that the tip end of the ink filling pipe 21 pushes the valve body 11 up against the elastic force of the spring 13 thereby to release the ink supply passage.

Then, the vacuum section is driven to move down while positioning the tip end of the vacuum pipe 24 with respect to the air communicating hole 1*a* of the ink cartridge 1, and a connecting port 24*a* of the vacuum pipe 24 comes into engagement liquid-sealably with the air communicating hole 1*a* of the ink cartridge 1. Under this condition, when a vacuum pump (not shown) is activated, a negative pressure is generated in the ink chamber 2 and, accordingly, air held in the porous member 2*a* is exhausted through the air communicating hole 1*a* of the ink cartridge 1. Thus, when the negative pressure becomes high enough to exceed the difference in water level of the ink cartridge 1 from the ink reservoir tank 20, ink K contained in the ink reservoir tank 20 comes to flow into the ink cartridge 1 and gradually impregnate in the porous member 2*a* by means of the capillary action of the porous member 2*a*.

During the ink filling operation, when predetermined ink is filled in the ink cartridge 1, the vacuum pump is deactivated to stop generating the negative pressure, the ink cartridge 1 is detached from the ink filling pipe 21. In this operation, the valve body 11 comes into abutment against the valve seat 10*a* because of the elastic force of the spring 13 as shown in FIG. 3A. Therefore, the ink supply port 3 is closed by the valve body 11 and ink is prevented from leaking out of the ink supply port 3 after the filling operation.

Figure 4:
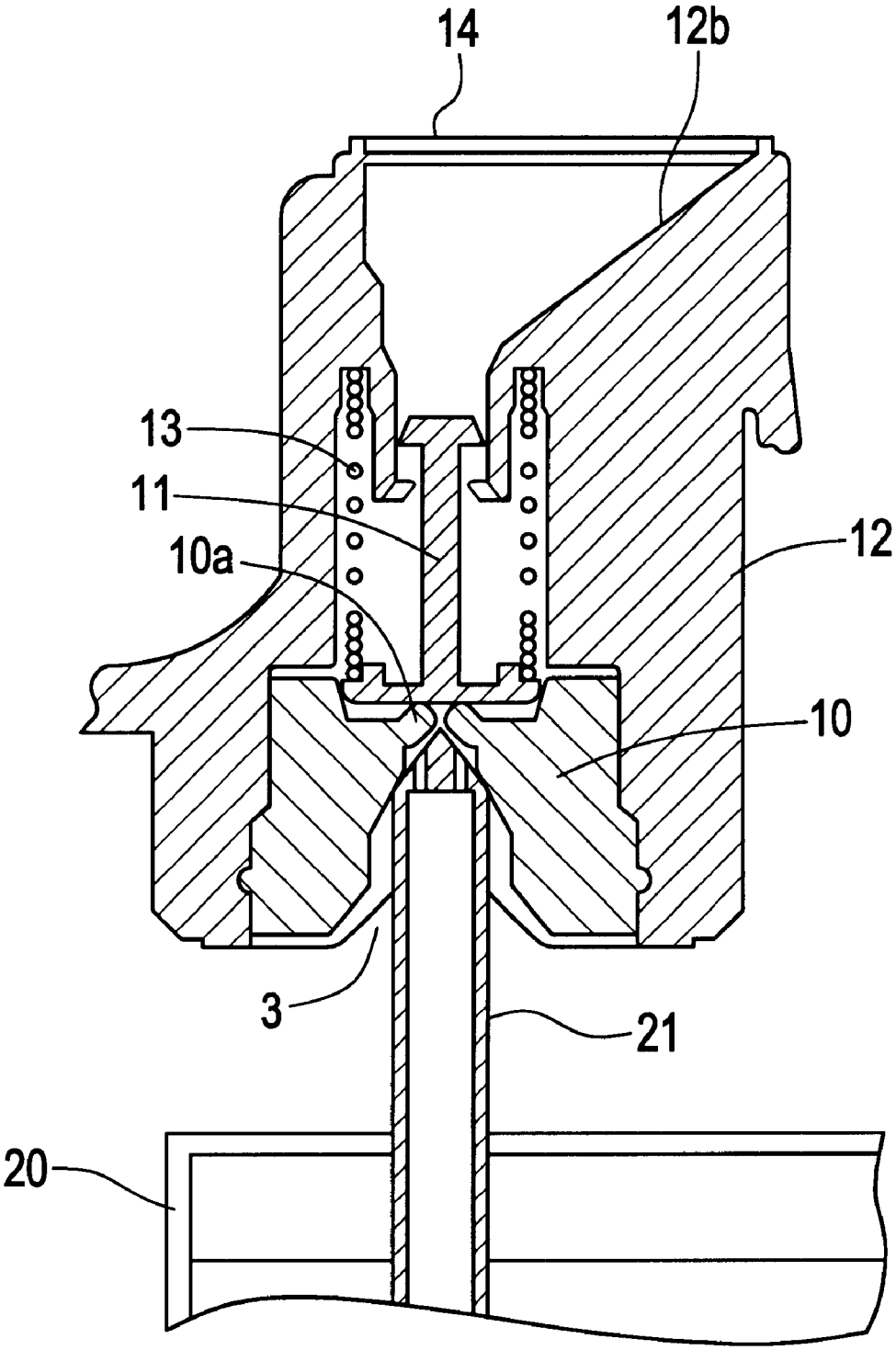
FIG. 4 is a sectional view showing another example of an ink supply port to which the ink filling technique of the present invention is applicable.

FIG. 4 is a sectional view showing another example of an ink supply port to which the ink filling technique of the present invention is applicable. As shown in FIG. 4, one wall of the opening of the ink supply port 3 at the ink chamber 2 side is formed with a slant surface 12*b* which enlarges toward the ink chamber 2. According to the present embodiment, because ink injected into the ink supply port 3 flows toward the porous member 2*a* through the slant surface 12*b*, ink can be filled up to far from the ink supply port 3 while air space at the opening 12*a* or air bubbles trapped by the filter 14 are pushed out far into the ink chamber 2.

Although the embodiments described above refer to the ink cartridge mounted on the carriage of the recording apparatus, the present invention is not limited thereto or thereby. For example, the invention may be applied to an ink cartridge for use in another type of recording apparatus in which the ink cartridge is not mounted on a carriage but a print head while the ink cartridge is mounted on a desired fixed part of the printing apparatus and ink contained in the ink cartridge is supplied to the print head through a flexible ink supply tube. In such arrangement, the same performance and function can be realized as the embodiments described above.

Further, in the above embodiments, ink K is sucked up from the ink reservoir tank 20 while vacuuming air in the ink cartridge 1 through air communicating hole 1*a*. However, another process is applicable in which air in the ink cartridge 1 is exhausted out through ink supply port 3 up to a predetermined low pressure level at a first step, and then the ink cartridge 1 is connected to the ink reservoir tank 20 for filling ink at a second, subsequent step. In this case, it is preferable that the air communicating hole 1*a* is previously sealed by, for example, fuse-bonding a peelable film, an exhausting pipe connecting to a vacuum pump is inserted into the ink supply port 3 while keeping airtight to thereby push up the valve body 11, decompressing the interior of the ink cartridge 1, and the exhausting pipe is removed when the negative pressure in the ink cartridge 1 reaches a predetermined low level. When the exhausting pipe is removed, the ink supply port 3 is sealed by the valve body 11 due to the elastic force of the spring 13 to maintain the low pressure condition inside the ink cartridge 1. Thereafter, the ink cartridge 1 is mounted on the ink filling apparatus and the ink filling pipe 21 communicating with the ink reservoir tank 20 is inserted into the ink supply port 3 so that ink is forced to flow into the interior of the ink cartridge 1 owing to the pressure difference between the interior of the ink cartridge 1 and that of the ink reservoir tank 20. Ink is thus filled in the ink cartridge 1. According to the present arrangement, because merely the ink supply port 3 performs both as an air outlet port and as an ink inlet port, the ink filling apparatus can be made simple in structure and small in size.

Figure 5:
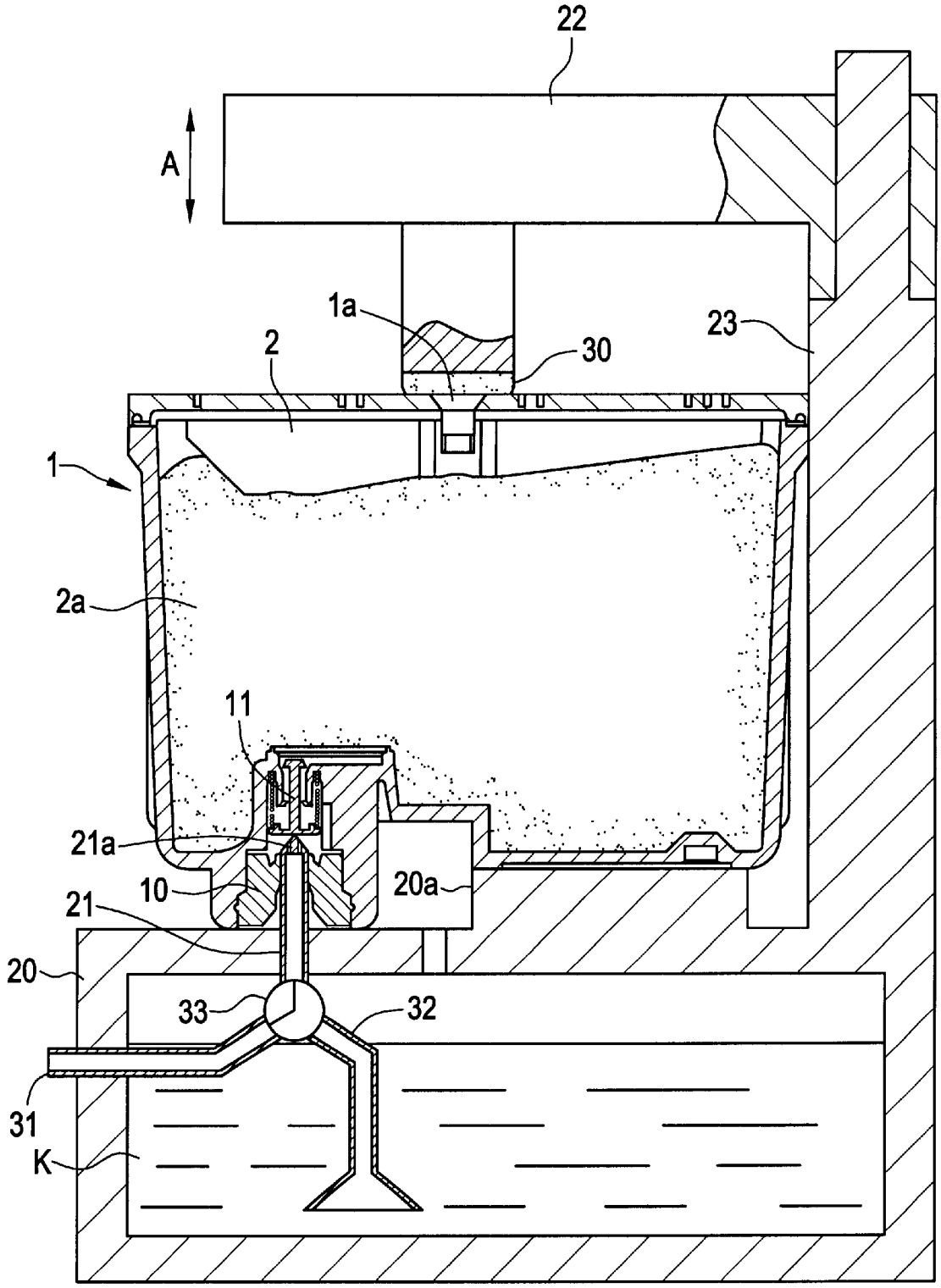
FIG. 5 shows an ink filling apparatus according to a second embodiment of the present invention.

FIG. 5 shows an ink filling apparatus according to a second embodiment of the present invention. As illustrated in FIG. 5, the ink filling apparatus is provided with a sealing member 30 which functions to seal the air communicating hole 1*a* of the ink cartridge 1 and an ink filling pipe 21 which engages liquid sealably with the ink supply port 3 of the ink cartridge 1. A selectively connecting device 33 is coupled to a lower end of the ink filling pipe 21, an ink communicating pipe 32 which opens to ink K contained in the ink reservoir tank 20, and a negative pressure applying pipe 31 connecting to a vacuum pump (not shown) which generates negative pressure. In this embodiment, a three-way valve is employed as one example of the selectively connecting device 33.

According to the second embodiment, when a depleted ink cartridge 1 is mounted on the ink filling apparatus, the valve body 11 is pushed up by ink filling pipe 21 and removed from the valve seat 10*a* to release the ink supply passage as shown in FIGS. 2 and 3. Subsequently, the ink filling pipe 21 is communicated with the negative pressure applying pipe 31 by operating the three-way valve 33, so that negative pressure is generated in the ink chamber 2 to exhaust air from the ink chamber 2 and from the porous member 2*a* housed therein. At a time when the ink chamber 2 is sufficiently decompressed, the three-way valve 33 is operated to switch the connection of the ink filling pipe 21 to the ink communicating pipe 32, the ink K comes to flow into the ink chamber 2 and the ink cartridge is filled with ink.

According to the second embodiment of the present invention, since air in the ink cartridge 1 is exhausted through ink supply port 3, air particularly in the vicinity of the ink supply port 3 can be withdrawn more assuredly and then ink can be filled particularly in the vicinity of the ink supply port 3 more assuredly. This is advantageous for a high quality ink cartridge in that the undesirable air flow to the print head 6 can be prevented while supplying only ink to the print head 6.

Further, in the above embodiment, air is exhausted independently from ink injection process. Owing to the process of the present invention, sufficiently strong negative pressure can be applied to the ink chamber 2 while taking enough time to accomplish it, and air held in the porous member 2*a* can be-assuredly removed out.

The same performance as the second embodiment can readily be realized also in the first embodiment shown in FIG. 2 merely by providing a stop valve in the middle of the ink filling pipe 21.

The afore-mentioned embodiments refer to the case where ink is filled immediately after the ink cartridge is decompressed. However, the porous member 2*a* may desirably be subjected to the hydrophilic treatment or ink-philic treatment before the ink filling process. In this case the decompression process may be omitted as ink can be filled in the porous member 2*a* owing to the capillary action generated by the porous member 2*a* itself.

Such hydrophilic treatment can be realized by impregnating porous member 2*a* with water, polyhydric alcohol such as ethylene glycol or glycerin or its aqueous solution, surfactant or its aqueous solution, or their composite solution and, thereafter, the porous member 2*a* is dehydrated and/or dried. Accordingly, the porous member 2*a* for the ink cartridge after the latter is depleted maybe filled with ink owing to the capillary action without conducting the decompression process because the porous member 2*a* is still hydrophilic. Assuming if ink is still remained in the porous member 2*a* after the volatile component is volatilized, it is preferable to adjust the component by, for example, dipping the porous member 2*a* into water so that ink cartridge having more stable characteristics can be manufactured.

Further, it is preferable that ink contained in the ink reservoir tank 20 is previously degassed by applying ink to air/water separating unit constructed by hollow filar membrane or contacting a zeolite such as Teflon™ thereby to remove gas dissolved in ink, so that the seepage performance of ink with respect to the porous member 2*a* can be improved, and the porous member 2*a* can readily impregnate ink entirely and uniformly.

Furthermore, in the embodiments described above, ink is injected by using the low pressure within the ink cartridge or capillary action by the porous member 2*a*. However, it is also applicable that degassed ink is compressed and supplied into the ink cartridge through the ink supply port by using a compression pump. The same or more improved ink filling performance can be realized by this arrangement.

By the way, when ink is injected under decompression or compression condition, ink reaches in the vicinity of the air communicating hole 1*a* and may expel out of the air communicating hole 1*a* immediately before completing the ink filling operation. Therefore, at least at the later stage of the ink filling process, air may preferably be injected through the air communicating hole 1*a* or the air communicating hole 1*a* may be sealed by a cover or the like immediately before the completion of the ink filling process, so that air pressure within the interior space is increased.

Figure 6A:
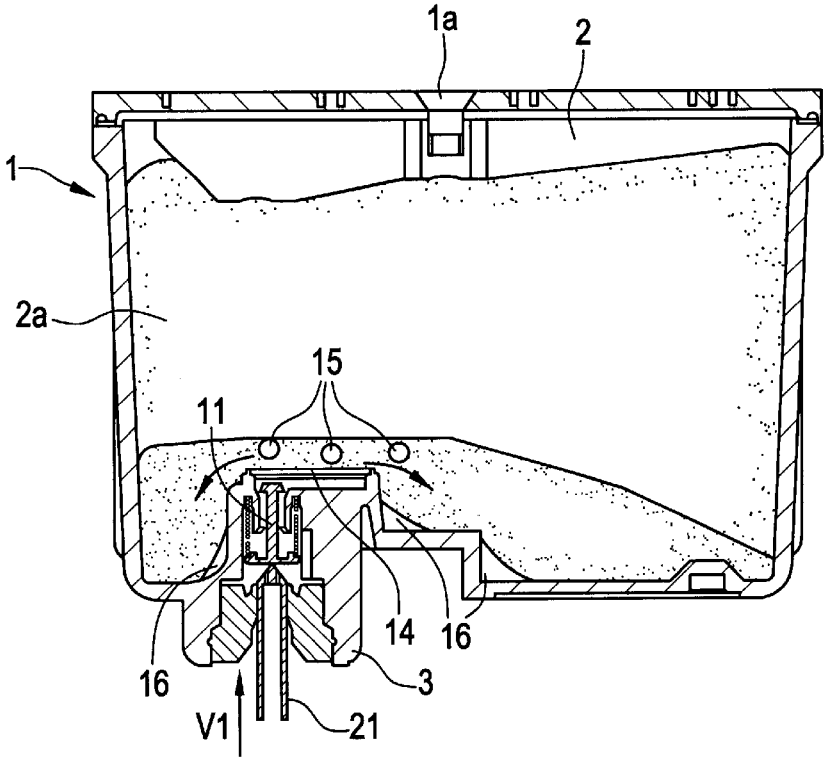
FIGS. 6A and 6B are views showing filling process of the ink filling apparatus shown in FIG. 5.

In addition, for the purpose of injecting ink in the vicinity of ink supply port while air is completely exhausted, the ink flow rate at the beginning of the ink filling process is set to be high, for example, 10 g/min. When the ink flow rate is high, air bubble sticking in the filter 14 is flushed into the porous member 2*a* due to the strong ink flow as shown in FIG. 6A. At the same time, because the ink flow rate is high, the flow of ink injecting into the ink chamber 2 through the ink supply port 3 projecting out from the bottom wall of the ink cartridge is bent in the horizontal direction of FIG. 6A along an arrow shown in the figure because of the large flow resistance of the porous member 2*a* at the portion just above the ink supply port 3. Then ink turns around the ink supply port 3 to flow to the lower part of the ink supply port 3 so that ink can enter an space 16 defined by the porous member 2*a* and an interior wall of the ink cartridge 1. Hence, even if there is such space 16 which is free of porous member 2*a*, ink can be filled in the space located in the vicinity of the ink supply port 3.

Figure 6B:
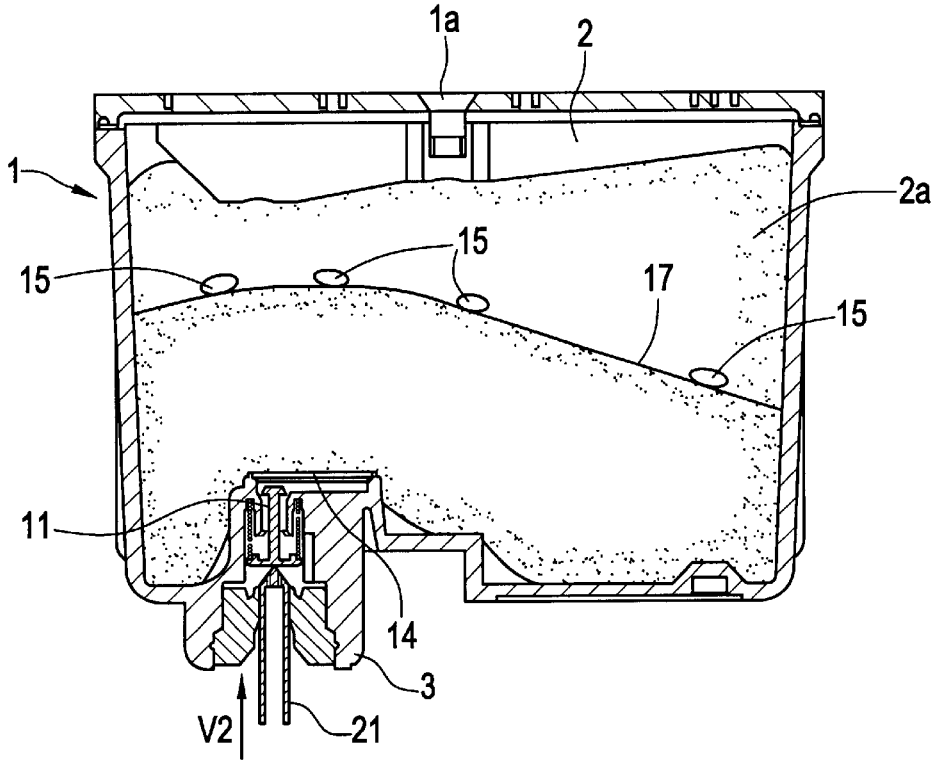

During the ink filling process, at a stage when a predetermined amount of ink, for example, a half of the capacity of the ink cartridge, is filled in the ink cartridge 1, the ink flow rate is changed to reduce down up to, for example, a half of the first flow rate, i.e., 5 g/min. After changing the ink flow rate, ink is gradually filled in the porous member 2*a*, and the air bubble 15 which is pushed out from the vicinity of the ink supply port 3 is carried upward by an ink wall 17 defined at the ink level as shown in FIG. 6B, and finally exhausted out through the air communicating hole 1*a*.

At the last stage of the ink filling process, even if the air bubbles is sticking or held by the porous member 2*a* in the vicinity of the ink supply port 3, such air bubbles are dissolved in ink if ink is fully degassed. Thus, lack of ink during the printing operation can be prevented.

On the other hand, if once excessive amount ink is intentionally filled in the ink cartridge up to exceeding the desired amount and, subsequently, the extra amount of ink is sucked and exhausted from the ink supply port 3, a part of ink dissolving air bubbles in the vicinity of the ink supply port 3 can be removed from the ink supply port 3. In this case, further, if fully degassed ink is injected in the ink cartridge excessively first, and then the extra amount of ink is exhausted out by vacuuming, the extra part of ink which is exhausted from the ink supply port 3 performs to dissolve air bubbles remained in the vicinity of the ink supply port 3. Accordingly, more improved ink cartridge with completely free of gas or air bubbles can be manufactured.

Moreover, in another arrangement, a first type of ink which has low concentration of pigment or dye component is injected at the beginning of the ink injection process, and then a-second type of ink which has high concentration of pigment or dye component is injected at the next step. By this arrangement, at the first step, the first ink having the low component concentration but having a easy impregnating performance can be readily impregnated within a region of the porous member 2*a* from the opening of the ink supply port 3 to the middle level thereof where the ink impregnating performance is relatively low at the beginning. Thus, the porous member 2*a* is wetted by the solvent of the first type of ink and turns out to be readily impregnating ink. Thereafter, the second type of ink having high component concentration is injected in place of the first type of ink. This arrangement is advantageous in that ink can be filled in the ink cartridge while sufficiently eliminating the air bubbles remained in the porous member 2*a*.

According to the arrangement mentioned above, when the ink filling process is completed, the second ink having high component concentration occupies the lower region of the porous member 2*a* in the vicinity of the ink supply port whereas the first ink having low component concentration occupies the upper region of the porous member 2*a*. However, during a time period after the ink cartridge thus filled with ink is shipped from the factory until it reaches a user, the formerly separated two different types of ink are mixed up together because of the fluid diffusion phenomena, and a uniform concentration of ink suitable for printing can be accomplished.

Figure 7:
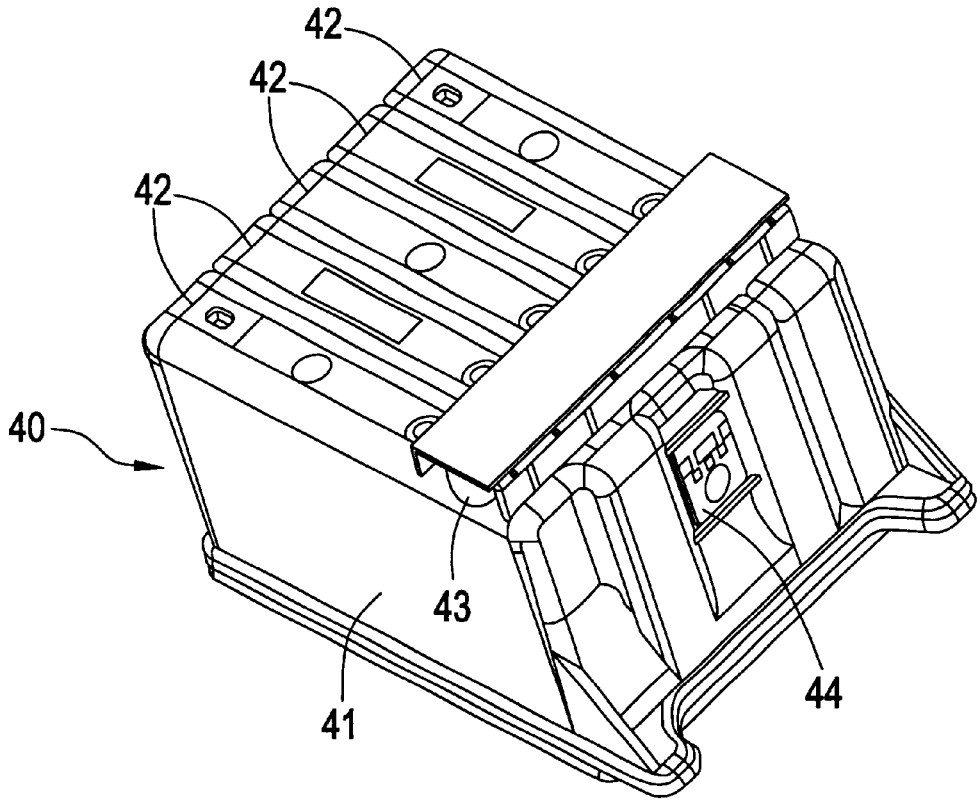
FIG. 7 is a perspective view showing one example of a color type ink cartridge.
Figure 8A:
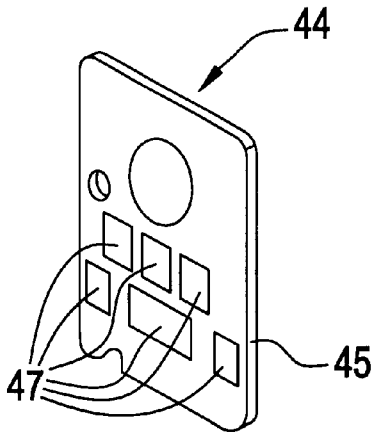
FIGS. 8A and 8B are perspective views showing a front and a rear structures, respectively, of a memory device attached to the ink cartridge shown in FIG. 7.
Figure 8B:
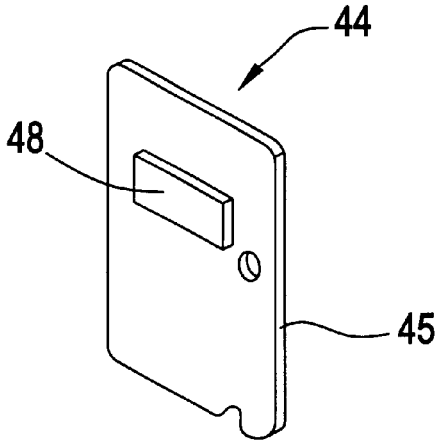
Figure 9:
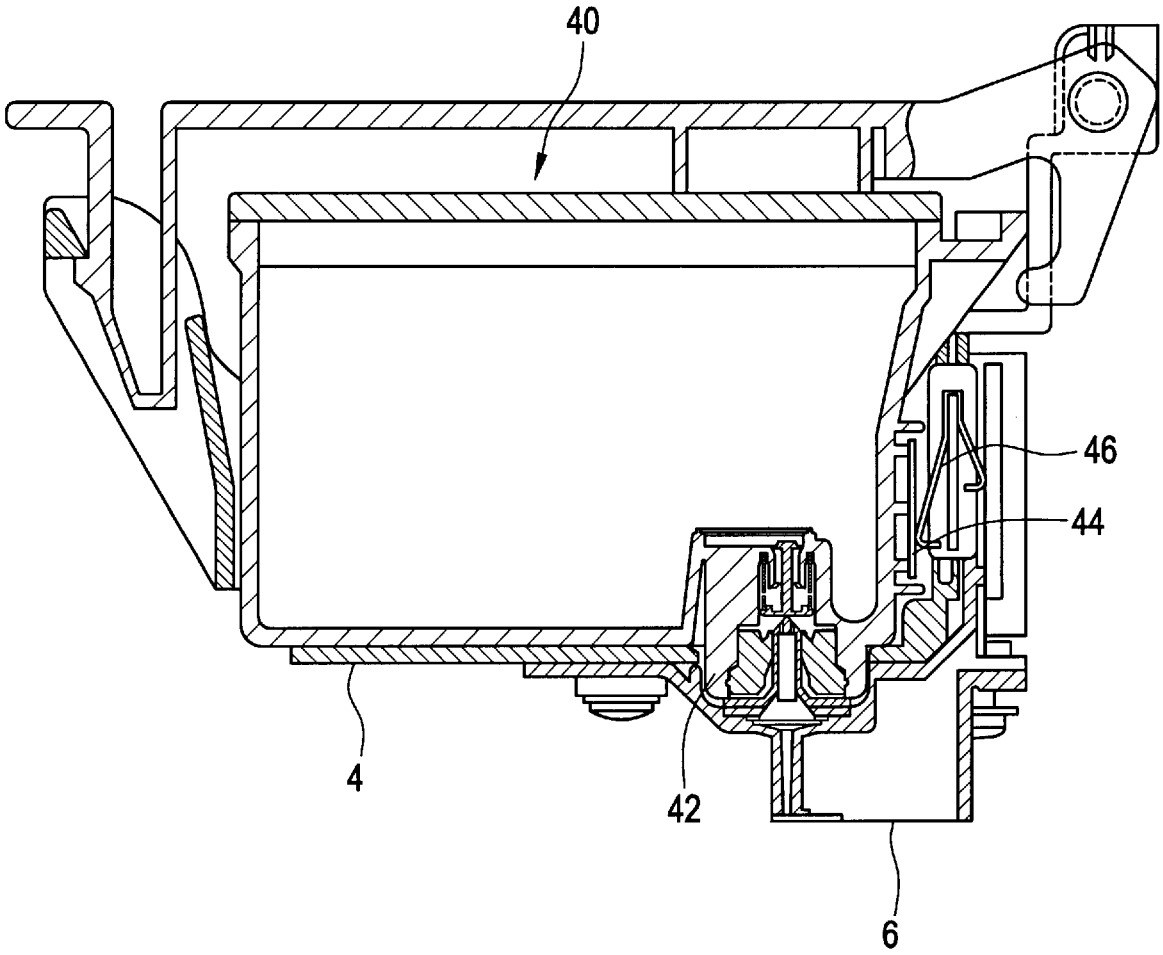
FIG. 9 is a sectional view showing the ink cartridge shown in FIG. 7 in a condition where the ink cartridge is mounted on a recording apparatus.

By the way, some recent ink cartridges are provided with a memory device which stores therein data prescribing printing conditions for the sake of reflecting a cartridge information such as an ink quantity, a manufacturing date, and a model number, and a change of printing condition caused by the improvement of ink itself. FIG. 7 is a perspective view showing one example of a color type ink cartridge of this type, FIGS. 8A and 8B are perspective views showing a front and a rear structures, respectively, of a memory device attached to the ink cartridge shown in FIG. 7, and FIG. 9 is a sectional view showing the ink cartridge shown in FIG. 7 in a condition where the ink cartridge is mounted on a recording apparatus. As shown in FIG. 7, an ink cartridge 40 is provided with a single, unitary housing 41 the interior of which is divided into a plurality of ink chambers, for example, five ink chambers 42*a*, 42*b*, 42*c*, 42*d* and 42*e* for different colors in this embodiment. An ink supply port 43 is formed on each of the ink chambers 42*a* to 42*e*, and a memory device 44 is attached on an outer surface of a side of the ink cartridge 40 for storing the data relating to the cartridge information mentioned above.

The memory device 44, as best shown in FIGS. 8A and 8B, is provided with a circuit board 45 and electrodes 47 formed on an outer surface of the circuit board 45 and a semiconductor storage element 48 electrically connecting to the electrodes 47. The electrodes 47 are arranged to contact with external contact terminals 46 of the ink jet type recording apparatus.

When the ink cartridge 40 thus designed is mounted on a predetermined position of a carriage 4 of the recording apparatus as shown in FIG. 9, the electrodes 47 of the memory device 44 come into engagement with the contacts 46 formed on the carriage 4 so that data stored in the semiconductor storage element 48 is read out by the control section of the recording apparatus, and the cartridge information is updated.

In a case where the ink cartridge 40 including the memory device 44 as mentioned above is collected from customers for recycling, the information in the memory device 44 is updated to the latest information, in which the information such as the information during the ink filling is added. By this rewriting, the recycled ink cartridge which stores the suitable information can be provided.

Figure 10:
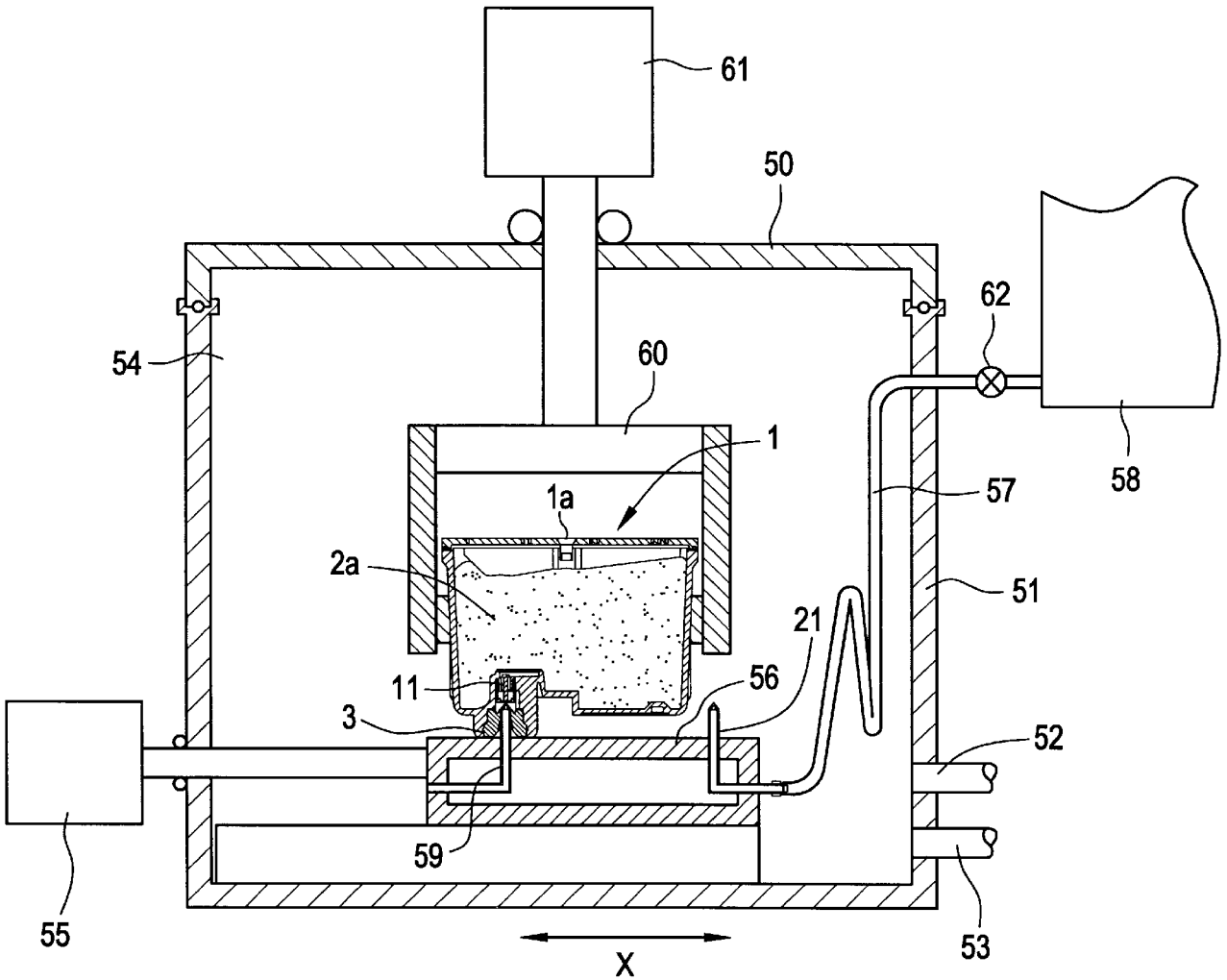
FIG. 10 is a schematic view showing an ink filling apparatus according to a third embodiment of the present in a condition during the ink vacuum operation.
Figure 11:
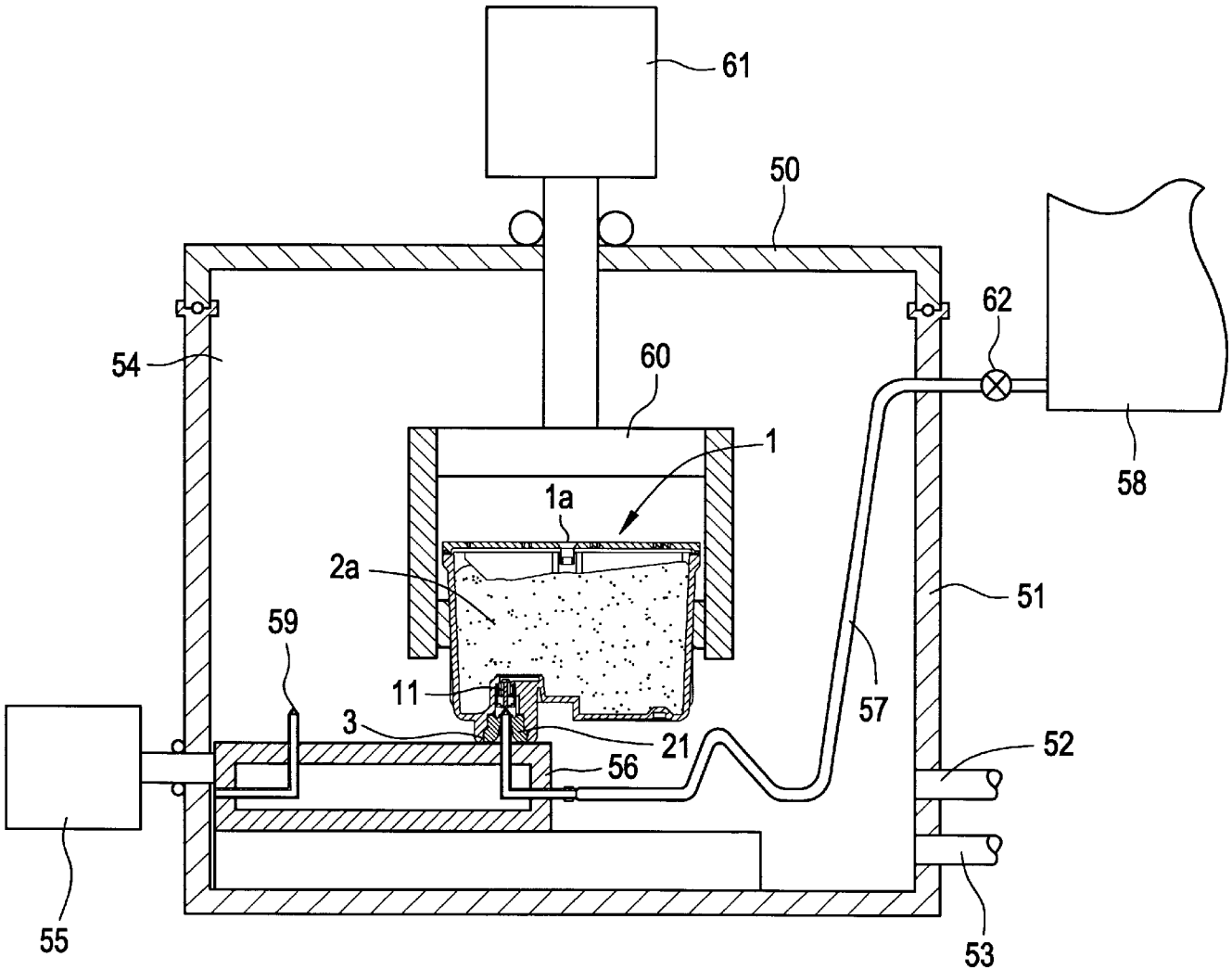
FIG. 11 is a schematic view of the ink filling apparatus shown in FIG. 10 in a condition during the ink filling operation.

In the above embodiment, air in the ink cartridge is exhausted through the air communicating hole 1*a* to decompress the interior thereof. However, the other arrangement, for example, the cartridge itself may be set within a vacuum chamber as shown in FIGS. 10 and 11 to achieve the same purpose. FIG. 10 is a schematic view showing an ink filling apparatus according to a third embodiment of the present in a condition during the ink vacuum operation, and FIG. 11 is a schematic view of the ink filling apparatus shown in FIG. 10 in a condition during the ink filling operation.

As shown in FIGS. 10 and 11, the ink filling apparatus is provided with a vacuum chamber body 51 which is sealed by a lid 50 so that an ink supply port 43 is defined. Openings 52 and 53, which connect to a vacuum pump and an ambient air releasing valve (not shown in the figures), respectively, are formed in a wall of the vacuum chamber body 51. A base member 56 is disposed at the bottom of the ink filling chamber 54. The base member 56 moves in a horizontal direction X by a drive mechanism 55. As shown in FIGS. 10 and 11, an ink filling pipe 21 connecting an ink reservoir tank 58 through a tube 57 and an air exhausting pipe 59 having the same structure as the ink filling pipe 21 and released into the ink filling chamber 54 are embedded in the base member 56 and arranged along a line in which the base member 56 moves. An elevating mechanism 61 having a holding arm 60 at a lower end thereof is disposed at an upper portion of the lid 50. Those component parts constitute an ink filling apparatus.

With the ink filling apparatus thus constructed, a depleted ink cartridge 1 is held by the holding arm 60, and the base member 56 is driven to move up to a position where the air exhausting pipe 59 faces the ink supply port 3. Subsequently, when the ink cartridge 1 is elevated down until the predetermined position by the elevating mechanism 61, the air exhausting pipe 59 is inserted into the ink supply port 3 as shown in FIG. 10, and the valve body 11 of the ink cartridge 1 is pushed up by the air exhausting pipe 59 to release the interior of the ink cartridge 1. Under such condition, the ink filling chamber 54 is decompressed, and air in the ink cartridge 1 is exhausted out of the ink cartridge 1 through the ink supply port 3 at a lower portion thereof and also through the air communicating hole 1*a* at an upper portion thereof. At a stage where the decompression level reaches a predetermined value, the ink cartridge 1 is elevated up by the elevating mechanism 61 and then the base member 56 is driven to move until a predetermined position where the ink filling pipe 21 faces the ink supply port 3. Finally, the ink cartridge 1 is elevated down by the elevating mechanism 61 up to a predetermined position, and the ink filling pipe 21 is inserted into the ink supply port 3 as shown in FIG.

Under the condition, a stop valve 62 of the tube 57 constituting an ink supply passage is released so that ink contained in the ink reservoir tank 58 which is compressed by the pressure difference from the ambient air flows into the ink cartridge 1 through the ink filling pipe 21. At a stage where a predetermined amount of ink is filled in the ink cartridge 1, if the pressure within the ink filling chamber 54 is increased by an ambient air releasing valve (not shown in the figures), ink can be prevented from leaking out of the ink cartridge 1 through the air communicating hole 1*a*.

If a sealing film is adhered on a surface of the ink cartridge 1 where the air communicating hole 1*a* is formed to seal the air communicating hole 1*a*, ink can be prevented from leaking out even though the pressure adjustment process mentioned above is not performed. When the air communicating hole 1*a* is sealed by the sealing film, the interior of the ink cartridge can be sufficiently decompressed because the air exhausting pipe 59 is inserted into the ink supply port 3 as described above.

In the above embodiment, ink is injected into the ink cartridge after the completion of the decompression process by using the ink filling chamber 54. Air in the interior space of the ink cartridge or held in the porous member 2*a* can be assuredly withdrawn because of a pressure impact if the filling process performs the following steps, that is, the cartridge is decompressed data first step, the pressure in the ink filling chamber 54 is increased at a second step, and the cartridge is decompressed again at a third step, in other words, if the decompression step for the ink filling is performed only after one or more cycle of air decompression and release to ambient air is conducted.

In addition, in the foregoing embodiment, ink is filled by the pressure difference from ambient air caused by the decompression applied to the ink filling region. However, another arrangement may be applicable. For example, ink may be compressed and introduced in the ink cartridge after air in the ink cartridge is withdrawn.

Furthermore, the ink cartridge 1 is attached to and detached from the ink filling pipe 21 and the air exhausting pipe 59 by actuating the elevating mechanism 61 in the embodiment mentioned above. However, another arrangement may also be applicable to achieve the same operation. For example, the ink cartridge is secured at a predetermined position, and the base member 56 is driven to move vertically and horizontally.

According to the present invention, as described above, because ink is filled in an ink cartridge having a housing communicating with ambient air through an air communicating hole, a porous member impregnating with ink, an ink supply port, and a valve device including a valve body always urged by a spring and a valve seat abutting against the valve body, and ink is filled in the housing of the ink cartridge through the ink supply port. Therefore, when the ink filling pipe is set in the ink supply port to thereby push up the valve body, so that the ink supply passage is released and ink is impregnated in the porous member through the ink supply port. Thereafter the ink is injected by the ink injection tube through the ink supply port, so that ink is impregnated in the porous member which is previously decompressed. Accordingly, according to the present invention, it is realized that ink can be sufficiently filled at a short time with a high filling condition particularly in the vicinity of the ink supply port without blocking the air communication hole by ink.

What is claimed is:

1. A method of filling an ink cartridge with ink, comprising:

engaging an ink filling pipe with an ink supply port of the ink cartridge;

vacuuming air within a housing through an air communication hole which communicates with an inside of the housing to decompress the housing of the ink cartridge; and filling the housing of the ink cartridge with ink through the ink supply port with the ink filling pipe.

2. The method as claimed in claim 1, wherein the vacuuming operation is performed during the filing operation.

3. The method as claimed in claim 1, wherein the vacuuming operation is performed before the filing operation.

4. A method of filling an ink cartridge with ink, wherein the ink cartridge has a single valve body selectively allowing ink to flow along an ink supply passage and wherein the method comprises:

engaging an ink filling pipe with an ink supply port of the ink cartridge;

pushing up the valve body placed in the ink supply port to release the ink supply passage; and filling ink in a housing of the ink cartridge through the ink supply port with the ink filling pipe.

5. A method of filling an ink cartridge with ink, comprising:

engaging an ink filling pipe with an ink supply port of the ink cartridge;

decompressing a housing of the ink cartridge while maintaining an outer shape of the housing; and filling ink in the housing of the ink cartridge through the ink supply port with the ink filling pipe while maintaining the outer shape of the housing.

6. The method as claimed in claim 5 wherein the ink is supplied by coupling air-sealably the ink supply port to a ink container which is released to ambient air.

7. A method of filling an ink cartridge with ink, wherein the ink cartridge has an ink supply port communicating with a print head of an ink jet printing apparatus and wherein the method comprises:

engaging an ink filling pipe with the ink supply port of the ink cartridge;

decompressing a housing of the ink cartridge while maintaining an outer shape of the housing; and filling ink in the housing of the ink cartridge through the ink supply port with the ink filling pipe while maintaining the outer shape of the housing.

* * * * *

UNITED STATES PATENT AND TRADEMARK OFFICE

CERTIFICATE OF CORRECTION

PATENT NO. : 6,539,985 B2 
DATED : April 1, 2003
INVENTOR(S) : Satoshi Shinada et al.

It is certified that error appears in the above-identified patent and that said Letters Patent is hereby corrected as shown below:

Please delete columns 11 and 12, claims 5-7 in their entirety.

Signed and Sealed this

Fourth Day of May, 2004

JON W. DUDAS
*Acting Director of the United States Patent and Trademark Office*